US009040799B2

(12) United States Patent
Penttinen et al.

(10) Patent No.: US 9,040,799 B2
(45) Date of Patent: May 26, 2015

(54) TECHNIQUES FOR ANALYZING PARAMETERS OF A MUSICAL PERFORMANCE

(71) Applicant: Aalto-korkeakoulusäätiö, Aalto (FI)

(72) Inventors: Henri Penttinen, Espoo (FI); Ole Kirkeby, Espoo (FI)

(73) Assignee: Aalto-Korkeakoulusäätiö, Aalto (FI)

( * ) Notice: Subject to any disclaimer, the term of this patent is extended or adjusted under 35 U.S.C. 154(b) by 0 days.

(21) Appl. No.: 14/287,615

(22) Filed: May 27, 2014

(65) Prior Publication Data

US 2015/0000505 A1 Jan. 1, 2015

(30) Foreign Application Priority Data

May 28, 2013 (FI) ..... 20135575

(51) Int. Cl.
*G10H 1/00* (2006.01)
*G10H 7/00* (2006.01)

(52) U.S. Cl.
CPC . *G10H 1/00* (2013.01); *G10H 7/002* (2013.01)

(58) Field of Classification Search
USPC ..... 84/600–602, 470 R
See application file for complete search history.

(56) References Cited

U.S. PATENT DOCUMENTS 5,525,062 A 6/1996 Ogawa et al.
5,612,502 A * 3/1997 Ura ..... 84/687
5,641,925 A * 6/1997 Koseki ..... 84/462
5,804,816 A * 9/1998 Yamamoto et al. ..... 250/221
5,824,930 A * 10/1998 Ura et al. ..... 84/462
6,245,985 B1 * 6/2001 Sasaki et al. ..... 84/658
6,297,437 B1 * 10/2001 Ura et al. ..... 84/423 R
6,407,321 B2 * 6/2002 Tamaki et al. ..... 84/20
6,933,435 B2 * 8/2005 Kato et al. ..... 84/724
6,933,494 B2 * 8/2005 Kato et al. ..... 250/239
7,049,576 B2 * 5/2006 Kato et al. ..... 250/221
7,432,431 B2 * 10/2008 Hirota et al. ..... 84/462

(Continued)

FOREIGN PATENT DOCUMENTS

WO WO 2006/115387 A1 11/2006

OTHER PUBLICATIONS

[Midi, 1995] Midi Manufacturers Association, Midi Implementation Chart (Version 2), 1995, URL: http://www.midi.org/techspecs/midi_chart-v2.pdf, pp. 1-7.

(Continued)

*Primary Examiner* — David Warren
(74) *Attorney, Agent, or Firm* — Birch, Stewart, Kolasch & Birch, LLP

(57) ABSTRACT

Techniques for analyzing a musical performance of a sequence of events. The events have parameters, such as timing, pitch and dynamics. A processor inputs (1-2) the performance; accesses (1-4) a standard performance of the musical piece; identifies (1-6) and compares (1-8) mutually corresponding events and determines (1-10) one of a set of classes: correct", "low" or "high". A current marker is displayed on an area of a display. The marker's position depends on the classification and the position of the previous marker, whereby trends and changes in performance accuracy are easily detected during performance.

13 Claims, 7 Drawing Sheets

(56) References Cited

U.S. PATENT DOCUMENTS

| | | | | |
|---|---|---|---|---|
| 7,473,841 | B2 * | 1/2009 | Fujiwara | 84/615 |
| 7,893,344 | B2 * | 2/2011 | Hirano | 84/745 |
| 7,902,448 | B2 * | 3/2011 | Kikumoto et al. | 84/615 |
| 8,686,270 | B2 * | 4/2014 | Eggink et al. | 84/600 |
| 8,754,317 | B2 * | 6/2014 | Sitrick et al. | 84/723 |
| 2001/0003945 | A1 * | 6/2001 | Muramatsu et al. | 84/658 |
| 2001/0016510 | A1 * | 8/2001 | Ishikawa et al. | 463/7 |
| 2001/0054346 | A1 * | 12/2001 | Uehara | 84/21 |
| 2002/0013166 | A1 * | 1/2002 | Yoshitomi | 463/7 |
| 2003/0084777 | A1 * | 5/2003 | Gaudet | 84/470 R |
| 2003/0110925 | A1 | 6/2003 | Sitrick et al. | |
| 2003/0201386 | A1 * | 10/2003 | Kato et al. | 250/239 |
| 2003/0202753 | A1 * | 10/2003 | Kato et al. | 385/88 |
| 2003/0202834 | A1 * | 10/2003 | Sato | 400/491.3 |
| 2004/0221711 | A1 * | 11/2004 | Kato et al. | 84/724 |
| 2005/0211048 | A1 * | 9/2005 | Fujiwara | 84/13 |
| 2006/0009979 | A1 | 1/2006 | McHale et al. | |
| 2006/0130640 | A1 * | 6/2006 | Fujiwara | 84/626 |
| 2006/0185497 | A1 * | 8/2006 | Hirota et al. | 84/423 R |
| 2007/0089592 | A1 | 4/2007 | Wilson et al. | |
| 2008/0017019 | A1 * | 1/2008 | Hirota et al. | 84/744 |
| 2008/0078281 | A1 * | 4/2008 | Katsuta | 84/609 |
| 2008/0257135 | A1 * | 10/2008 | Hirota | 84/658 |
| 2008/0276790 | A1 * | 11/2008 | Lemons | 84/477 R |
| 2008/0276791 | A1 * | 11/2008 | Lemons | 84/483.2 |
| 2008/0302233 | A1 | 12/2008 | Ding et al. | |
| 2009/0151548 | A1 * | 6/2009 | Kikumoto et al. | 84/640 |
| 2009/0178533 | A1 * | 7/2009 | Koseki et al. | 84/171 |
| 2011/0003638 | A1 | 1/2011 | Lee et al. | |
| 2011/0252947 | A1 * | 10/2011 | Eggink et al. | 84/609 |
| 2014/0020543 | A1 * | 1/2014 | Oba et al. | 84/20 |
| 2014/0102285 | A1 * | 4/2014 | Koseki et al. | 84/609 |

OTHER PUBLICATIONS

Bello et al., "A Tutorial on Onset Detection in Music Signals", IEEE Transactions on Speech and Audio Processing, vol. 13, No. 5, Sep. 2005, pp. 1035-1047.

Bello et al., "Phase-Based Note Onset Detection for Music Signals", In Proc. IEEE Int. Conf. Acoust., Speech, Signal Proces. Hong Kong, China, 2003, pp. V-441-V-444.

Boley et al., "Measuring Dynamics: Comparing and Contrasting Algorithms for the Computation of Dynamic Range", Audio Engineering Society Convention 129, Paper No. 8178, San Francisco, CA, USA, Nov. 4-7, 2010, 5 pages.

Charpentier, "Pitch Detection Using the Short-term Phase Spectrum", Acoustics, Speech, and Signal Processing, IEEE International Conference on ICASSP '86., vol. 11, pp. 113-116, Apr. 1986.

Chuan et al., "The Effect of Key and Tempo on Audio Onset Detection Using Machine Learning Techniques: A Sensitivity Analysis", Proceedings of the Eighth IEEE International Symposium on Multimedia (ISM'06), 2006 IEEE, 6 pages.

De Cheveignë et al., "Yin, a Fundamental Frequency Estimator for Speech and Music", J. Acoust. Soc. Am. vol. 111, No. 4, Apr. 2002, pp. 1917-1930.

Holzapfel et al., "Three Dimensions of Pitched Instrument Onset Detection", IEEE Transactions on Audio, Speech, and Language Processing, vol. 18, No. 6, Aug. 2010, pp. 1517-1527.

Klapuri et al., "Robust Multipitch Estimation for the Analysis and Manipulation of Polyphonic Musical Signals", In Proc. Cost-G6 Conference on Digital Audio Effects, DAFx-00, Verona, Italy, 2000, 6 pages.

Klapuri, "Sound Onset Detection by Applying Psychoacoustic Knowledge", Proc. IEEE Int. Conf. Acoust., Speech, Signal process. Mar. 1999, pp. 3089-3092.

Rabiner et al., "A Comparative Performance Study of Several Pitch Detection Algorithms", IEEE Transactions on Acoustics, Speech, and Signal Processing, vol. Assp-24, No. 5, Oct. 1976, pp. 399-418.

Tolonen et al., "A Computationally Efficient Multipitch Analysis Model", IEEE Transactions on Speech and Audio Processing, vol. 8, No. 6, Nov. 2000, 2000 IEEE, pp. 708-716.

* cited by examiner

TECHNIQUES FOR ANALYZING PARAMETERS OF A MUSICAL PERFORMANCE

FIELD OF THE INVENTION

The present invention relates to methods, devices and computer program products for analyzing parameters of a musical performance.

BACKGROUND OF THE INVENTION

Learning to play an instrument, or to sing, requires years of practice. In order to progress as fast as possible an aspiring musician will usually take lessons from a teacher who can give constructive feedback and who can tell the student what to work on. However, for the student, lessons are rare compared to practice sessions. A student will practice on several days between lessons and on those days the student does not receive any help or feedback. However, with sophisticated software running on a data processing device it is possible to create a virtual teacher that can determine some parameters of a musical performance without the need for a human assessment. A number of virtual teacher programs exist. A problem with the prior art virtual teacher programs is that the output from them is quite limited, at least during a live performance. More detailed analyses of the musical performance may be available in a summary section of the program, but lack of real-time guidance remains a problem. For instance, a virtual teaching program that analyses the performance after the performance has ended provides little useful feedback to the musician regarding what changes in body or hand position caused what changes in performance.

SUMMARY OF THE INVENTION

It is an object of the present invention to alleviate one or more of the problems identified above. Specifically, it is an object of the present invention to provide methods, equipment and computer program products that provide improvements with regard to one or more of analysis of a musical performance, in particular a real-time analysis of a live performance in a manner which enables a musician to correct aspects of playing during the live performance, whereby the invention and/or its embodiments bring about improvements to the motor skills of the musician.

An aspect of the present invention is a method comprising analyzing a performance of a musical piece wherein the musical piece comprises a sequence of musical events, wherein at least some of the musical events have a plurality of parameters, wherein the parameters are selected from a group which comprises timing, pitch and dynamics;

wherein said analyzing comprises execution of following acts on a data processing system:

inputting the performance of the musical piece;

accessing a standard performance of the musical piece;

identifying a plurality of mutually corresponding events in the musical performance and in the standard performance, wherein the events have one or more parameters;

for each identified event:

comparing one or more parameters of the musical performance with corresponding parameters of the standard performance;

for each of the one or more compared parameters, determining one of a set of classes and, wherein the set of classes comprises:

a "correct" class for parameters within a given tolerance margin of the corresponding parameter of the standard performance;

a "low" class for parameters below the corresponding parameter of the standard performance; and a "high" class for parameters above the corresponding parameter of the standard performance;

for each of the one or more compared parameters, displaying a current marker on an area of a display, wherein the area is defined by a corner for each of the classes;

determining a position for the current marker as a step from the position of a previous marker, or from a start position if no previous marker exists, wherein the direction of the step indicates the determined class and wherein the length of the step is based on at least the distance from the previous marker to the corner for the determined class; and using a set of one or more visual attributes that distinguish the currently displayed marker from a background and/or the previous marker, if any, in the determined position.

In some implementations the performance of the musical piece is a live performance and the analyzing comprises real-time execution of the acts of the inventive method. In the present context, real-time analysis and presentation of a live performance means fast enough so that the musician may learn, during the performance, which parameters of their performance are off target and in which direction, so that the musician can get quick feedback regarding how changes in their technique cause changes in the parameters that indicate correctness of the performance. While a real-time analysis of a live performance is no serious challenge to a modern data-processing system, the real-time analysis has consequences as regards legibility and clarity of the information provided to the musician. For instance, the classification of the parameters of the event, and the trend of classification should be immediately apparent to the musician? Is the musician playing sharp? Or flat? At which point does the performance shift from early to late? Or from too loud to too quiet? Such problems relating to presentation can be solved by features of the invention and/or its embodiments which improve quick and clear indications of trends in the play. For instance, it is important that new markers indicating classification of recent parameters of musical events are easily distinguished from markers of earlier parameters.

In some implementations the set of classes also comprises a "missed" class for events that were omitted or events in which the parameter of the musical performance deviates from the corresponding parameter of the standard performance by more than a predetermined threshold.

For human test subjects, missed events may arise from entirely different errors than poorly played events, such as notes. Poor playing typically reflects poor technique while missed events typically reflects poor reading of music, lack of attention or both. Accordingly, it is beneficial to treat and display misses separately from poorly played events. The desire to provide immediately apparent information can be satisfied by treating events as "misses" if the error is so big that the probable reason for the error was not poor playing but inattention or poor reading of music.

In a typical but non-restrictive implementation, the parameters comprise timing, pitch and level. For timing, the "low" and "high" classes mean early and late, respectively. For pitch, "low" class means flat and "high" class means sharp. For level, "low" class means too quiet and "high" class means too loud.

In some implementations the step size towards the corner corresponding to the classification may depend on other factors besides the distance from the previous marker to the corner for the determined class. For instance, if the classification changes from "low" to "high" or vice versa, the step size may be longer than usually. In an illustrative but non-restrictive example, the step from "low" to "high" or vice versa may be implemented in such a manner that the end point of the step towards the corner of the new, changed, classification is calculated as if the starting point was on the line of correct performance. For instance, assume that the vertical y axis bisects the area to sections of "low" and "high" parameters. The end point for the step corresponding to the change in classification is calculated from the vertical y axis. But because no marker is placed on the y axis, the visible step length is the sum of steps form the previous marker to the y axis and from the y axis to the new end position.

In some implementations the step size towards the corner of the classification may depend on a match between the compared parameter and the determined class. What this means is that the larger the error, the larger the step towards the corner of the classification, until the error is so large that the event is classified as a "miss".

Very much useful information of a student's performance can be obtained by analyzing musical events with respect to three independent parameters or components, namely timing, pitch, and dynamics. In some implementations of the invention, timing has two component: a start time and a duration of an event. Some elements of phrasing, such as vibrato or tremolo, cannot be adequately analyzed by these three parameters as mutually independent components. The inventors have discovered, however, that analyzing timing, pitch, and dynamics as mutually independent parameters (components) provides valuable improvements over prior art techniques. Some ambitious implementations of the invention also evaluate phrasing, such as vibrato or tremolo. Like many musical terms, vibrato and tremolo are subject to a variety of different definitions. For the purposes of the present invention, vibrato is a function of pitch versus time (frequency modulation) and tremolo is function of dynamics (loudness) versus time (amplitude modulation). Evaluation of vibrato involves analyzing the center, depth and/or rate of the vibrato. This can be done, for instance, by using a smoothed version (eg a sliding average) of the particular parameters. The center frequency of the vibrato is average or median frequency around which the vibration oscillates. The modulation depth is the amount of the frequency change above and below the center frequency. The rate means the repetition rate or an inverse of the repetition period. For tremolo the parameters are analogous with those of vibrato but an average level is used instead of center frequency and the depth refers to change in level above and below the average level.

The necessity of observing variations in pitch or dynamics causes an additional unavoidable delay. But for the purposes of the present invention, real-time processing should be understood in the context of improving the musician's motoric skills. As long as implementations of the present invention provide feedback to the musician quickly enough for the musician to remember what change in playing was related to what change in performance, the processing can be considered real-time processing. For instance, if the musician notices that the markers for pitch suddenly begin to move towards the low (flat) corner. The musician may remember that two seconds ago his/her position changed, and the musician is notified of the change in performance, and a corrective measure may be taken and the same mistake can be avoided in the future. Known techniques for measuring parameters relating to timing, pitch and dynamics are listed at the end of this description. The same techniques, namely observation of pitch and/or dynamics as a function of time over the duration of a note or a sequence of notes, can be used for evaluating other aspects of phrasing, such as staccato or legato.

Regarding determination of performance scores for the various parameters of a musical event, the data processing system compares each of the analyzed parameters with corresponding parameters of the standard performance. No difference between the analyzed musical performance and the standard performance obviously results in a perfect or best possible score, which on a normalized scale may be indicated as 1 or 100%. In some implementations a tolerance margin around a parameter's ideal value (the value of the corresponding parameter in the standard performance) may be applied. Larger differences from the parameter's ideal value may decrease the performance score. In an illustrative but non-restrictive implementation, increasing differences result in lower scores only up to a point. For instance, playing a clearly wrong note or playing the right note at the time of its neighbor note or clearly playing forte instead of piano result in lowest possible scores for pitch, timing and dynamics (level), respectively. Any mistakes bigger than these may be treated as missed events instead of merely assigning a poor score to them.

BRIEF DESCRIPTION OF THE DRAWINGS

In the following section, specific embodiments of the invention will be described in greater detail in connection with illustrative but non-restrictive examples. A reference is made to the following drawings.

DETAILED DESCRIPTION OF SOME SPECIFIC EMBODIMENTS

Figure 1:
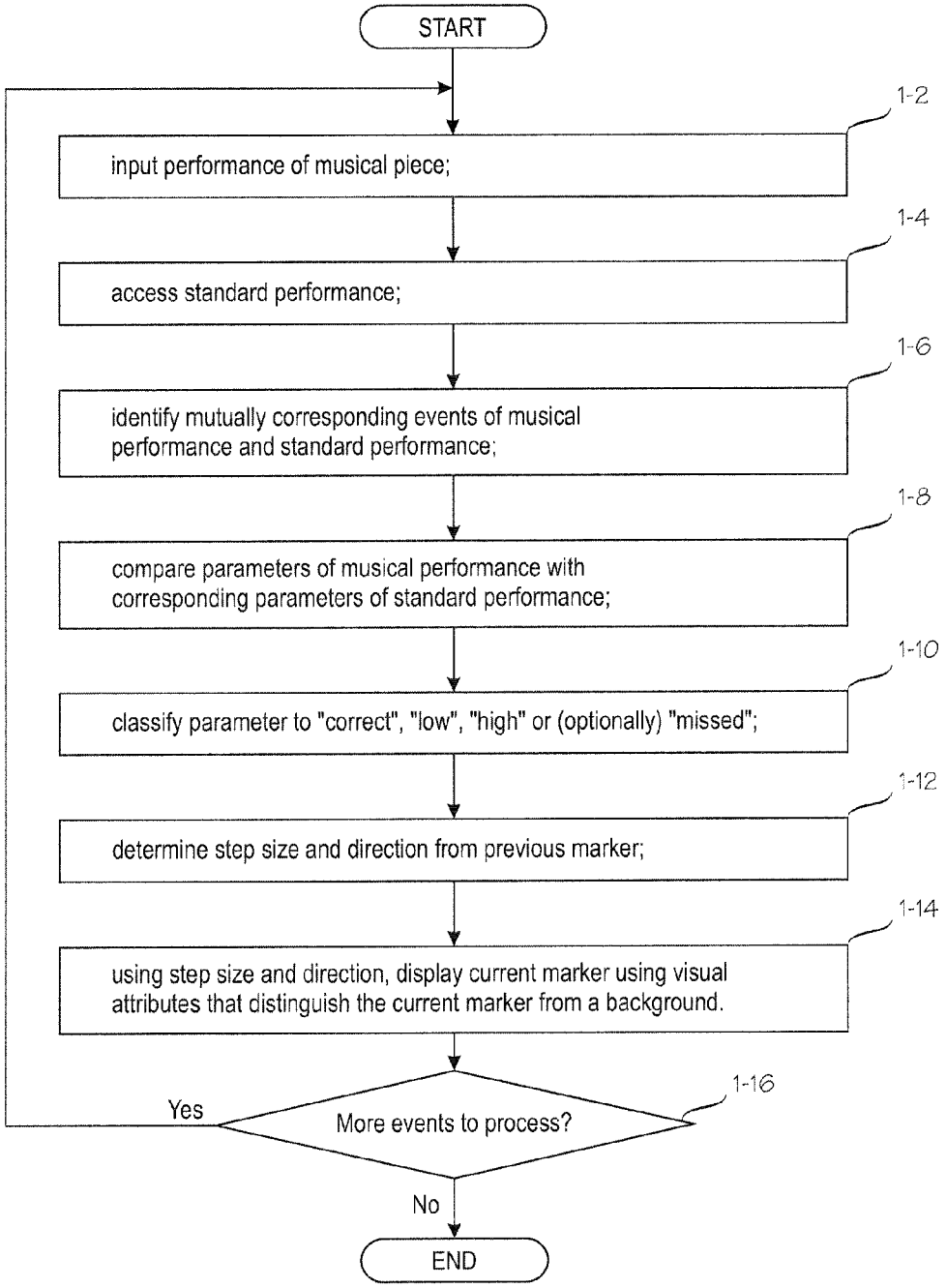
FIG. 1 is a flow chart illustrating an operating principle of the invention.

In the attached drawings and the following description, like reference numbers denote like items and a repeated description is omitted. The first digit of a two-part reference number indicates the drawing in which the element is first introduced. For instance, all elements having reference numbers 1-*xx* are introduced in FIG. 1.

FIG. 1 is a flow chart illustrating a method according to an embodiment of the invention. The method comprises analyzing a performance of a musical piece, which comprises a sequence of musical events. At least some of the musical events have a plurality of parameters, which are selected from a group comprising timing, pitch and dynamics (level).

An exemplary data processing system ("computer") will be described in connection with FIG. 8. The method comprises execution of following acts on the computer. The numbered acts are not necessarily executed in the same order as they are described, unless a subsequent step clearly requires prior execution of a preceding act.

Step 1-2: inputting the performance of the musical piece into the computer. The musical piece must be parsed into events, such as notes and pauses. There are several alternative techniques for doing this. In some implementations, the instrument may have a MIDI interface (Musical Instrument Digital Interface). MIDI interfaces are ubiquitous in connection with keyboard instruments, such as synthesizers, but there are other instruments with MIDI interfaces too. Output from a MIDI-enabled instrument is automatically parsed into events.

In some implementations, parsing from a continuous analog or digital signal into discrete events is done externally to the computer described herein, and the computer described herein receives the musical piece in a form which is already parsed into events. In yet other implementations, the parsing is performed by the computer described herein, using any of existing techniques, some of which are described at the end of this description.

Step 1-4: accessing a standard performance of the musical piece. Step 1-6: identifying a plurality of mutually corresponding events and parameters in the musical performance and in the standard performance. Step 1-8: comparing one or more parameters of the musical performance with corresponding parameters of the standard performance. Step 1-10: classifying the parameter values (determining one of a set of classes for the parameter value), wherein the set of classes comprises: a "correct" class for parameters within a given tolerance margin of the corresponding parameter of the standard performance; a "low" class for parameters below the corresponding parameter of the standard performance; and a "high" class for parameters above the corresponding parameter of the standard performance; and, optionally, a "missed" class for events that were omitted or events in which the parameter of the musical performance deviates from the corresponding parameter of the standard performance by more than a predetermined threshold. Step 1-12: determining a position for the current marker as a step from the position of a previous marker, or from a start position if no previous marker exists, wherein the direction of the step indicates the determined class and wherein the length of the step is based on at least the distance from the previous marker to the corner for the determined class. Step 1-14: displaying a current marker using one or more visual attributes that distinguish the currently displayed marker from a background and/or the previous marker, if any, in the determined position. For instance, as regards the visual attributes that distinguish the currently displayed marker from a background and/or the previous marker, the current marker may have the strongest contrast against the background, such as the brightest marker against a dark background or vice versa, and for earlier markers the contrast may be faded.

In step 1-16 the system tests if the musical performance comprises more events to process. If yes, the flow returns to step 1-2 for inputting more of the musical performance. Otherwise the process is completed.

Figure 2:
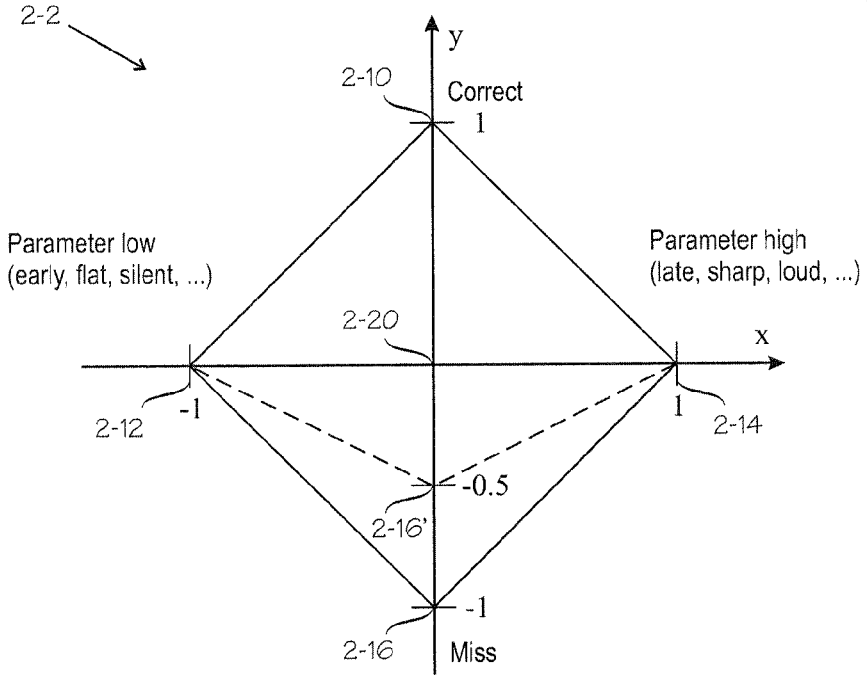
FIG. 2 illustrate a coordinate system and an area of a computer display for placing markers that indicate classification of certain parameters to correct, low, high or miss.

FIG. 2 shows an area 2-2 of a computer display demarcated by four corners. The area is overlaid on an x-y coordinate system. In the present example, the x-y coordinate system has been normalized between −1 and +1 for both axes. Each corner corresponds to a specific classification of a parameter. Reference number 2-10 denotes a corner for the correct class, which is placed at (x=0, y=1). For the purposes of the invention, a "correct" value for a parameter is usually understood to lie within certain tolerance limits from the value of the corresponding parameter in the standard performance. Reference numbers 2-12 and 2-14 denote corners for "low" and "high" classifications at (−1, 0) and (1, 0), respectively. For timing, pitch and level, respectively, the "low" class means early, flat and quiet, while the "high" class means late, sharp and loud. Quiet or loud are not absolute levels but levels of events of the musical performance which are compared to those of the standard performance. Before comparison, the input level of the musical performance should be calibrated or normalized to a level which enables meaningful comparison with the standard performance. Reference number 2-20 denotes the origin of the area, which serves as an intuitive starting point for the step (vector) of the first event.

When a new note event is detected the current position (x, y) inside the pyramid is updated to ($x_{new}$, $y_{new}$) with a step towards the corner that represents its classification. The coordinates of the corner corresponding to the class are denoted ($x_c$, $y_c$). In a simple, albeit non-restrictive, implementation the step length is a fixed fraction g of the distance from the previous position to the corner of the current class. The update equations for $x_{new}$ and $y_{new}$ as a function of x, y, $x_c$, and $y_c$ then become:

$$x_{new}=g_1\cdot(x_c-x)+x \tag{1}$$

and $$y_{new}=g_2\cdot(y_c-y)+y \tag{2}$$

In the above equations 1 and 2, the factor g, which gives the step length as a fraction of the previous position to the selected corner, has been indicated as $g_1$ and $g_2$. This means that the factor g is not necessarily the same for x and y.

It was said earlier that the area 2-2 demarcated by corners 2-10, 2-12, 2-14 and 2-16 was normalized between −1 and +1 for both of the x and y axes. This is not necessary, however, and particularly the corner 2-16 for missed events can be moved closer to the origin. In FIG. 2, reference number 2-16' denotes a corner for missed events shifted to (0. −0.5). In some implementations the missed class and corner 2-16 can be omitted altogether, in which case events with too low or too high parameter values are simply treated as low or high, regardless of how big the error was. If the computer system is unable to detect an event altogether, the missed event can be indicated by alternative means, such as a blink or sound.

Figure 3:
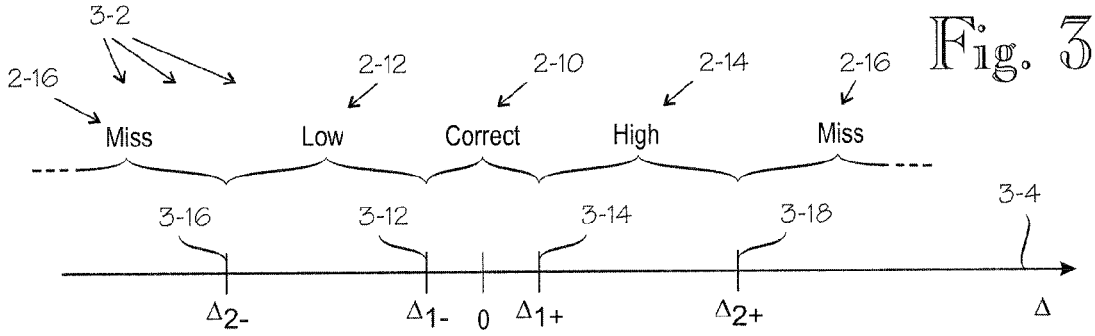
FIG. 3 illustrates a simple classification scheme.

FIG. 3 illustrates a simple classification scheme generally denoted by reference number 3-2. Reference number 3-4 denotes an axis for a difference Δ between parameter values of events in the musical performance and the standard performance. There is a point of 0 error on the Δ axis 3-4. A parameter with zero error is obviously classified in the "correct" class 2-10. The same holds for parameters with differences within a tolerance margin ($\Delta_{1-}$, $\Delta_+$). The tolerance margins ($\Delta_-$, $\Delta_+$) are not necessarily symmetrical around the point of zero error. Parameter values below the first negative error limit $\Delta_{1-}$, denoted by reference number 3-12 are classified into the "low" class 2-12. Parameter values above the first positive error limit $\Delta_{1+}$, denoted by reference number 3-14 are classified into the "high" class 2-14. Optionally, parameter values below a second negative error limit $\Delta_{2-}$, denoted by reference number 3-16, or above a second positive error limit $\Delta_{2+}$, denoted by reference number 3-18, may be classified into the "missed" class 2-16.

Figure 4:
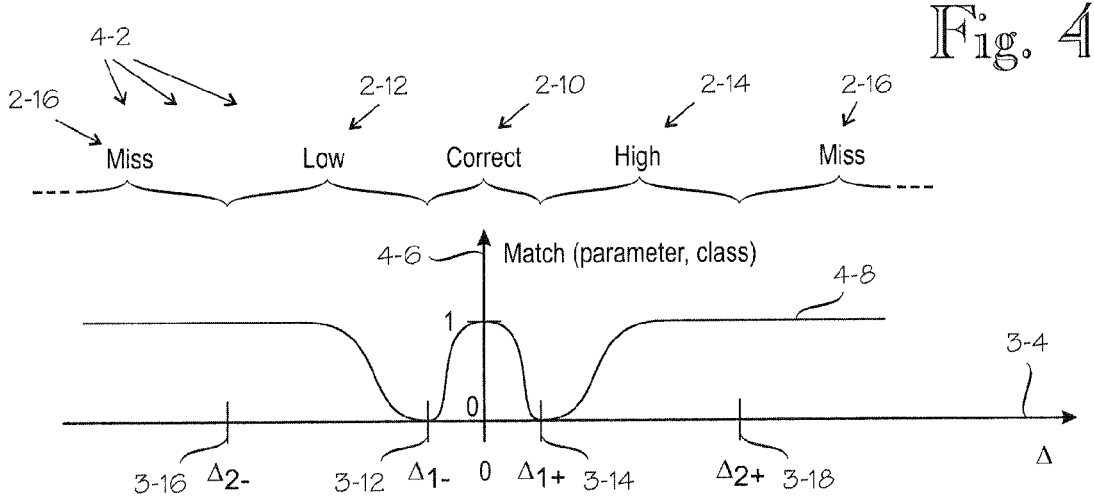
FIG. 4 illustrates an alternative classification scheme.

FIG. 4 illustrates an alternative classification scheme generally denoted by reference number 4-2. In the classification scheme discussed in connection with FIG. 3, the parameter values were classified into one of the classes regardless of how clearly the value belonged to a class or, conversely, how close the value was to one of the boundary points 3-12, 3-14, 3-16 or 3-18. The classification scheme 4-2 involves a match value, denoted by reference number 4-8, that indicates a coupling or match between a parameter value and its classification. In the example shown in FIG. 4, at the boundary points 3-12, 3-14 for the first negative and positive limits ($\Delta_{1-}$, $\Delta_{1+}$), the match factor 4-8 has a very low value, such as zero, and the match factor 4-8 approaches unity for parameter values farther away from the boundary points 3-12, 3-14. In an alternative implementation, the match factor 4-8 remains at one between the boundary points 3-12, 3-14 for the first negative and positive limits ($\Delta_{1-}$, $\Delta_{1+}$), and values less than one are only applied for values outside the tolerance margins 3-12, 3-14 ($\Delta_{1-}$, $\Delta_{1+}$).

Figure 5:
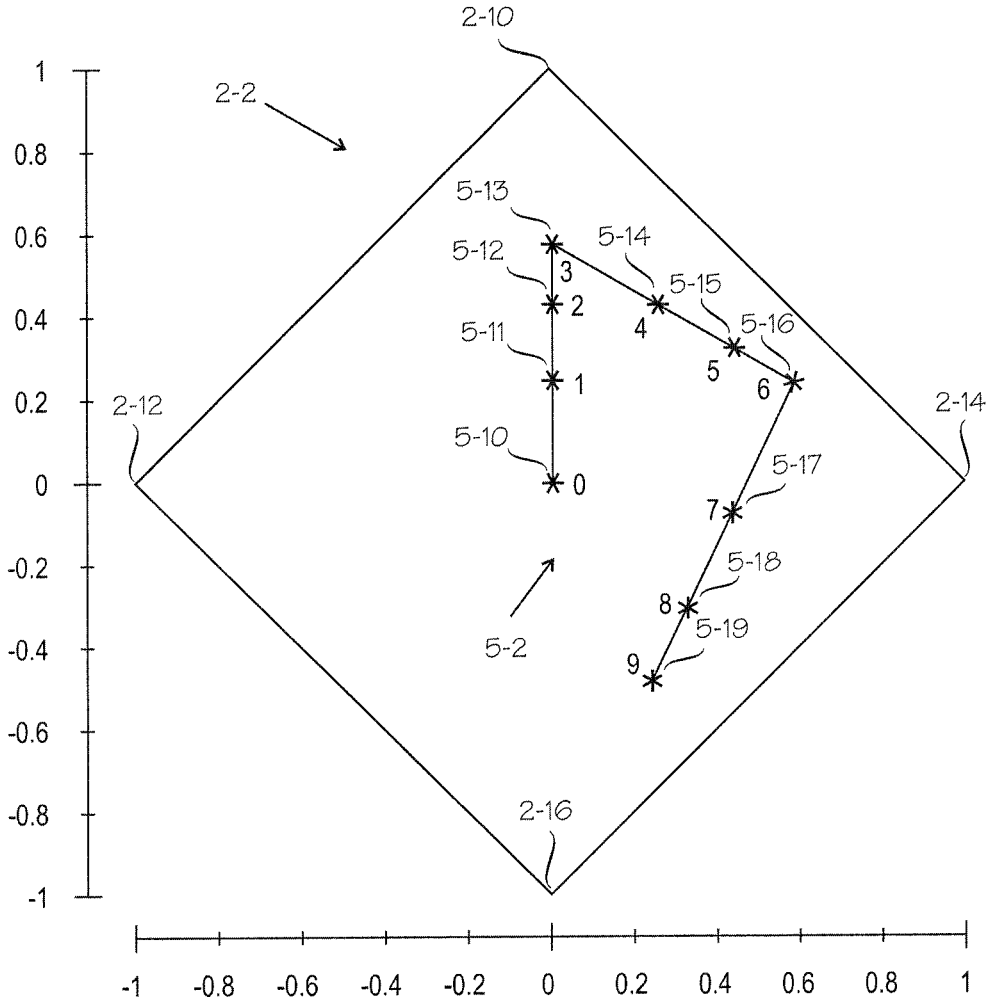
FIGS. 5 and 6 show two hypothetical traces of markers indicating classification of the parameters.
Figure 6:
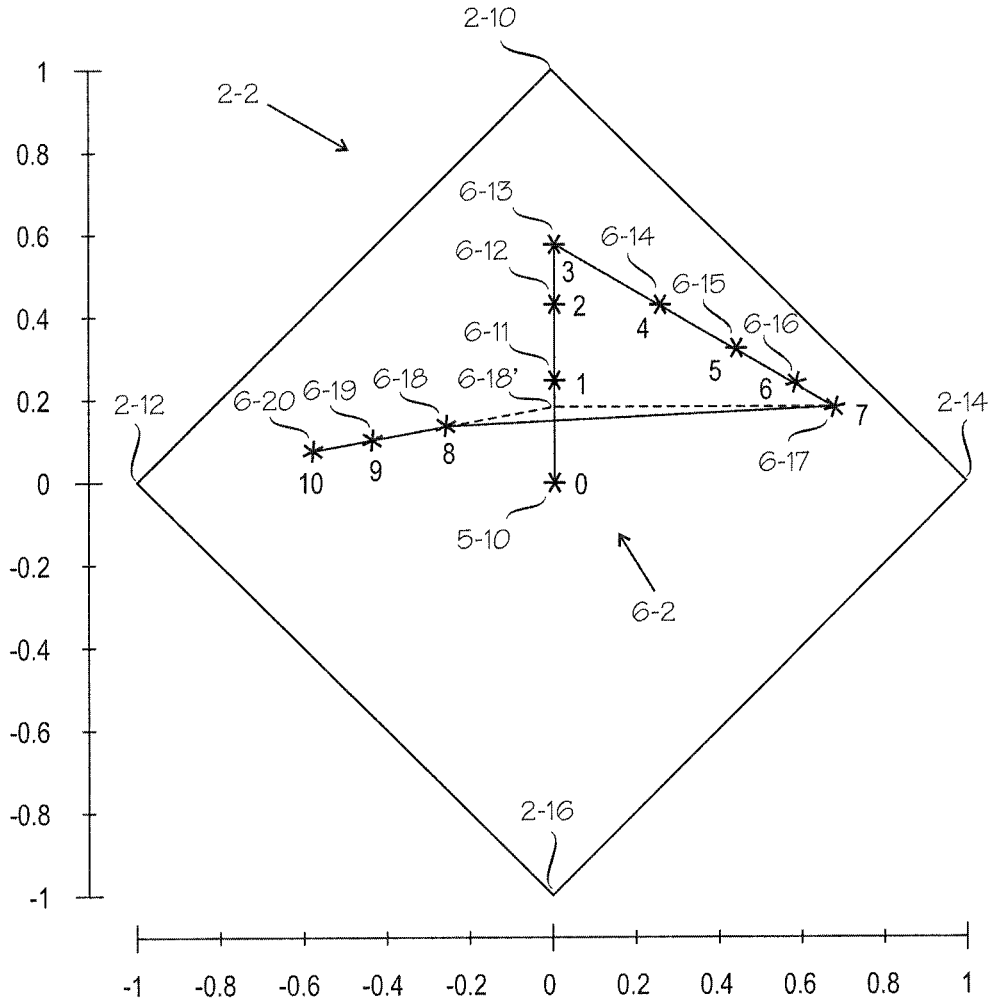

FIGS. 5 and 6 show two hypothetical traces of markers indicating classification of the parameters. FIG. 5 shows a series of markers for a parameter value sequence 5-2, that begins with three "correct" values, continues with three "high" values and finishes with three "missed" values. Equations (1) and (2) are used to calculate step sizes, with values of $g_1=g_2=0.25$.

Reference numbers 5-10 denotes a starting marker at the origin (0, 0), while reference numbers 5-11 through 5-19 denote markers for the nine parameter values. The three first steps, denoted by markers 5-11 through 5-13 from the previous marker (or origin) are directed towards the corner 2-10 of the "correct" class, because the parameter values were classified as "correct". For each of the three first steps, the distance from the previous marker (or origin) to the corner 2-10 of the "correct" class is reduced by the g factor, which in this example is 0.25, or one quarter. The next three steps, denoted by markers 5-14 through 5-16 from the previous marker are directed towards the corner 2-14 of the "high" class, because the parameter values were classified as "high". For instance, a "high" parameter value may mean late, sharp or too loud, depending on whether the parameter being evaluated is timing, pitch or level. Again, the distance to the corner 2-14 of the "high" class is reduced by 0.25 for each step. Similarly, the next last steps, denoted by markers 5-17 through 5-19 from the previous marker are directed towards the corner 2-16 of the "missed" class, because the parameter values were classified as "missed", or the event couldn't be detected at all. The remaining distance to the corner 2-16 of the "missed" class is reduced by 0.25 for each step.

FIG. 6 shows an optional feature in connection with a parameter value sequence 6-2, that begins with three "correct" values, continues with four "high" values and finishes with three "low" values. Again, equations (1) and (2) are used to calculate step sizes, with values of $g_1=g_2=0.25$. Reference number 5-10 denotes the origin and reference numbers 6-11 through 6-20 denote end markers for the ten steps.

Based on the description of FIG. 5, the scenario shown in FIG. 6 is easy to understand, up to the eighth marker 6-18, which follows the last of the four "high" values indicated by markers 6-14 through 6-17. According to the optional feature, a change in classification from "low" to "high" or vice versa is indicated by a step size larger than normal. In the example of FIG. 6, such a change in classification was detected for the parameter indicated by marker 6-18. An illustrative but non-restrictive technique for indicating the classification change with an oversize step is seen in FIG. 6, wherein for the marker 6-18, a new start position 6-18' is placed at (0, y), wherein y is they value of the previous marker 6-17. The new start position 6-18' is only used for calculations but is not indicated on the computer display. From new start position 6-18' the step to the end position 6-18 is calculated as described above, and a line (vector) from the previous position 6-17 to the new position 6-18 may be drawn if desired. The three remaining "low" parameter values are indicated normally by markers 6-18 through 6-20.

Figure 7:
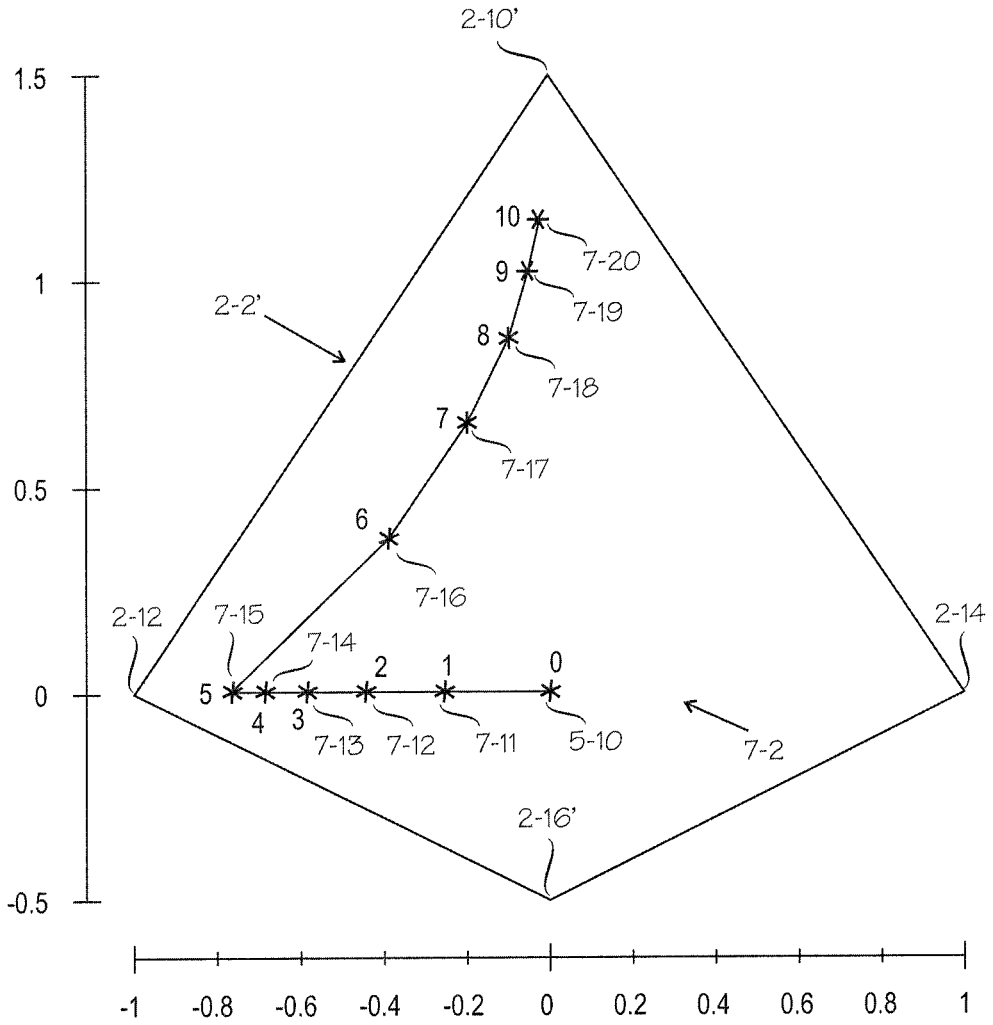
FIG. 7 shows further optional features in connection with a different parameter value sequence.

FIG. 7 shows further optional features in connection with a parameter value sequence 7-2, that begins with five parameters classified as "low", followed by another "correct" parameter values. The markers for the ten parameter values are denoted by reference numbers 7-11 through 7-20. A first change from the previous implementations is that the display area, denoted herein by 2-2', is not symmetrical about the x axis. Instead the corner for the "correct" class, denoted by reference number 2-10', is placed at (0, 1.5), while the corner 2-16' for the "missed" class is placed at (0, −0.5). A second difference is that the $g_1$ and $g_2$ factors for the x and y parameters in equations (1) and (2) are not identical. Instead, for this example, $g_1=0.5$ and $g_2=0.25$. What this means is that the x coordinate changes twice as rapidly compared with the y coordinate.

Figure 8:
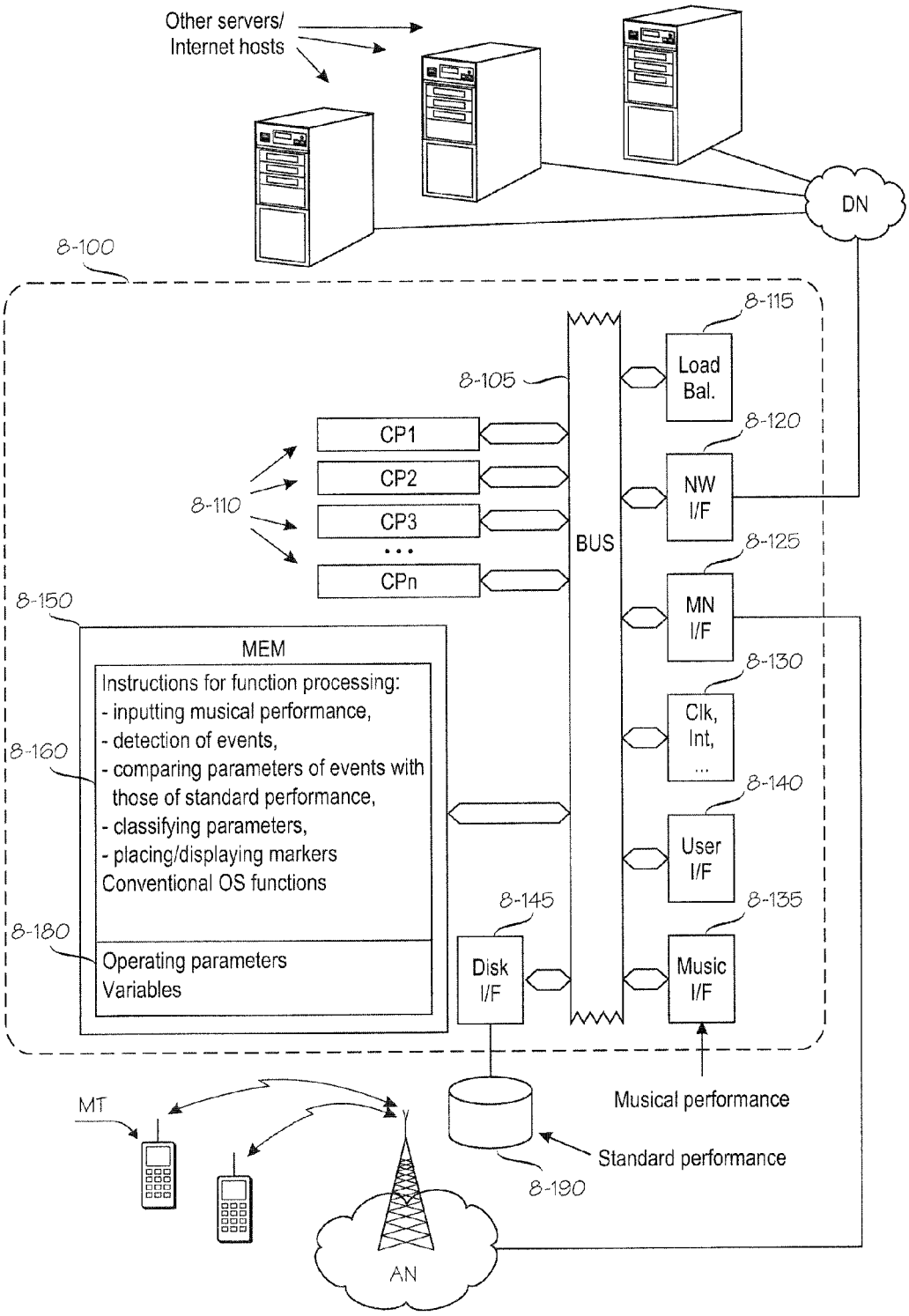
FIG. 8 schematically shows a data processing system adapted for real-time analysis of a musical performance.

FIG. 8 schematically shows a data processing system adapted for real-time analysis of a musical performance. For the sake of clarity and brevity, the data processing system will be called a computer. It is to be noted, however, that an ability to act as a general-purpose computer is not essential for the present invention or its embodiments.

The architecture of the computer, generally denoted by reference numeral 8-100, comprises one or more central processing units CP1 . . . CPn, generally denoted by reference numeral 8-110. Embodiments comprising multiple processing units 8-110 are preferably provided with a load balancing unit 8-115 that balances processing load among the multiple processing units 8-110. The multiple processing units 8-110 may be implemented as separate processor components or as physical processor cores or virtual processors within a single component case. In a typical implementation the computer architecture 8-100 comprises a network interface 8-120 for communicating with various data networks, which are generally denoted by reference sign DN. The data networks DN may include local-area networks, such as an Ethernet network, and/or wide-area networks, such as the internet. The data processing system may also reside in a smart telephone, in which case reference numeral 8-125 denotes a mobile network interface, through which the smart telephone may communicate with various access networks AN.

The computer architecture 8-100 may also comprise a local user interface 8-140. Depending on implementation, the user interface 8-140 may comprise local input-output circuitry for a local user interface, such as a keyboard, mouse and display (not shown). The computer architecture also comprises memory 8-150 for storing program instructions, operating parameters and variables. Reference numeral 8-160 denotes a program suite for the server computer 8-100.

The computer architecture 8-100 also comprises circuitry for various clocks, interrupts and the like, and these are generally depicted by reference numeral 8-130. The computer architecture 8-100 further comprises a storage interface 8-145 to a storage system 8-190. When the server computer 8-100 is switched off, the storage system 8-190 may store the software that implements the processing functions, and on power-up, the software is read into semiconductor memory 8-150. The storage system 8-190 also retains operating and variables over power-off periods. The various elements 8-110 through 8-150 intercommunicate via a bus 8-105, which carries address signals, data signals and control signals, as is well known to those skilled in the art.

For inputting music to be analyzed, the computer architecture 8-100 comprises at least one sound, or music, interface 8-135. By way of example, the music interface can be a microphone-level or line-level analog interface, or it can be a Universal Serial Bus (USB) interface, to name just a few of the most common types of music interfaces.

The standard performance, in turn, can be received or obtained via any of a number of digital interfaces, such as the network interfaces 8-120, 8-125, via a USB bus or a Musical Instrument Digital Interface (MIDI) bus, to name just a few of the most common types of digital interfaces. It is also possible to receive the standard performance via the music interface 8-135, possibly in analog form, and digitalize it. This way a teacher, for instance, can play a performance that the computer later uses as the standard performance.

The inventive techniques may be implemented in the computer architecture 8-100 as follows. The program suite 8-160 comprises program code instructions for instructing the processor or set of processors 8-110 to execute the functions of the inventive method, including the acts or features described in connection with FIG. 1 and, optionally, the acts or described in connection with FIGS. 2 through 7.

The various optional features described in connection with different drawings can be combined freely. In other words, the optional features are not restricted to the embodiments in connection with which they are first described. For instance, the non-symmetrical placement of the "correct" and "missed" corners 2-10', 2-16' about the x axis can be applied to the corners 2-12, 2-14 of the "low" and "high" classes. The different $g_1$ and $g_2$ factors for the x and y parameters in equations (1) and (2), as shown in connection with FIG. 7, can be combined with other optional features. The same holds for the embodiment described in connection with FIG. 4, wherein a match or coupling factor between a parameter value and the classification is calculated, and this coupling factor is used to reduce step size for parameter values that are closed to borderline values. Alternatively, the match or coupling factor may be applied for step sizes towards the "low" or "high" corners but not towards the "correct" corner.

Further Optional Features and Variations

A sequence of markers clearly distinct from one another is believed to be optimal for indicating correctness of performance to the musician during a live performance. Earlier markers can be removed or faded away as newer markers are added. For overall analysis of a recorded performance techniques other than distinct markers may be used. For instance, a "heat map" can be used to indicate which portions of the display area were most occupied during the performance. In the present context, a heat map refers to display techniques wherein the probability of a portion of a display area to be occupied is mapped to a range of visual indicators, such as varying shades of grey, different colors, hatching or textures. Alternatively, other multi-dimensional display techniques, such as 3D bar codes or surface diagrams can be used. In yet other implementations, a heat map can be overlaid by a sequence of markers, wherein the heat map shows long-term analysis and the sequence of markers indicates accuracy of recent events.

Improvements to Motor Skills

In addition off-line analysis of a recorded performance, the invention and/or its embodiments are applicable to a real-time analysis of a live performance, and thus have the capability to bring about improvements to the motor skills of the musician. Some aspects of the invention and/or its embodiments are particularly advantageous for real-time analysis of a live performance. For instance, it is important that changes in classification of events, such as a change from early to late or from sharp to flat, are clearly presented to the musician. This way the musician, who may have altered the position of their body or hands, receives immediate feedback on the effects that the altered position has on accuracy of performance. These design goals are supported by various features, such as making the step size between markers dependent on the distance to the corner of the classification. This ensures that markers for a sequence of events rarely overlap each other, as would be the case if constant-size steps were used, and the classification changes direction (eg low to high or vice versa). The desire to make classification changes more visible is further supported by taking a step bigger than normal when the classification changes.

In order to further improve the real-time feedback given to the musician, the computer may be programmed to change some of the factors that influence placement of the markers as the musician's performance improves. For instance the classification of event parameters into correct, low, high or missed (cf. FIG. 3) can be tightened as the musician progresses and the markers tend to occupy the positions near the "correct" corner. Alternatively or additionally, the coupling factor (cf. FIG. 4) or the $g_1$ and $g_2$ factors in equations 1 and 2 can be adjusted to make the "correct" corner more difficult to reach. Naturally, the tightened classification and/or other factors should be indicated to the musician.

The tightened classification or a difficulty level changed otherwise can be indicated to the musician(s) by displaying an explicit difficulty level as a symbol, such as a number, or by changing the color, size and/or shape, or some other visual attributes, of the markers that indicate classification. For instance, when the musician has attained a level at which several consecutive events are classified as correct, the markers tend to cluster near the corner for the correct class, and it may be difficult or impossible to distinguish a newer marker from an underlying older marker. This residual problem can be solved by dynamically altering one or more visual attributes of the markers. For instance, the color of the markers may be changed according to a scheme which ensures that a newer marker is visually distinct from a co-located older marker.

While the attached drawings show only one display area 2-2 at a time, a more detailed indication to the musician can be given by showing multiple display areas 2-2 simultaneously, one for each analyzed parameter, such as start time, duration, pitch and level.

In a variation of this idea, multiple parameters can be displayed on the same display area 2-2 by using markers of different shape, size and/or color. In some implementations, the computer can indicate which of the parameters is deemed to deviate the most from the standard performance. The parameter(s) needing the most attention from the part of the musician may be highlighted on the display, or it/they can be selected as the only one(s) being displayed.

In some implementations the multiple display areas belong to multiple musicians. There are several ways to utilize display areas belonging to different musicians. For instance, the different musicians can simply compare their own displays with those of the others and see who's performance is the most (or least) accurate.

Figure 9:
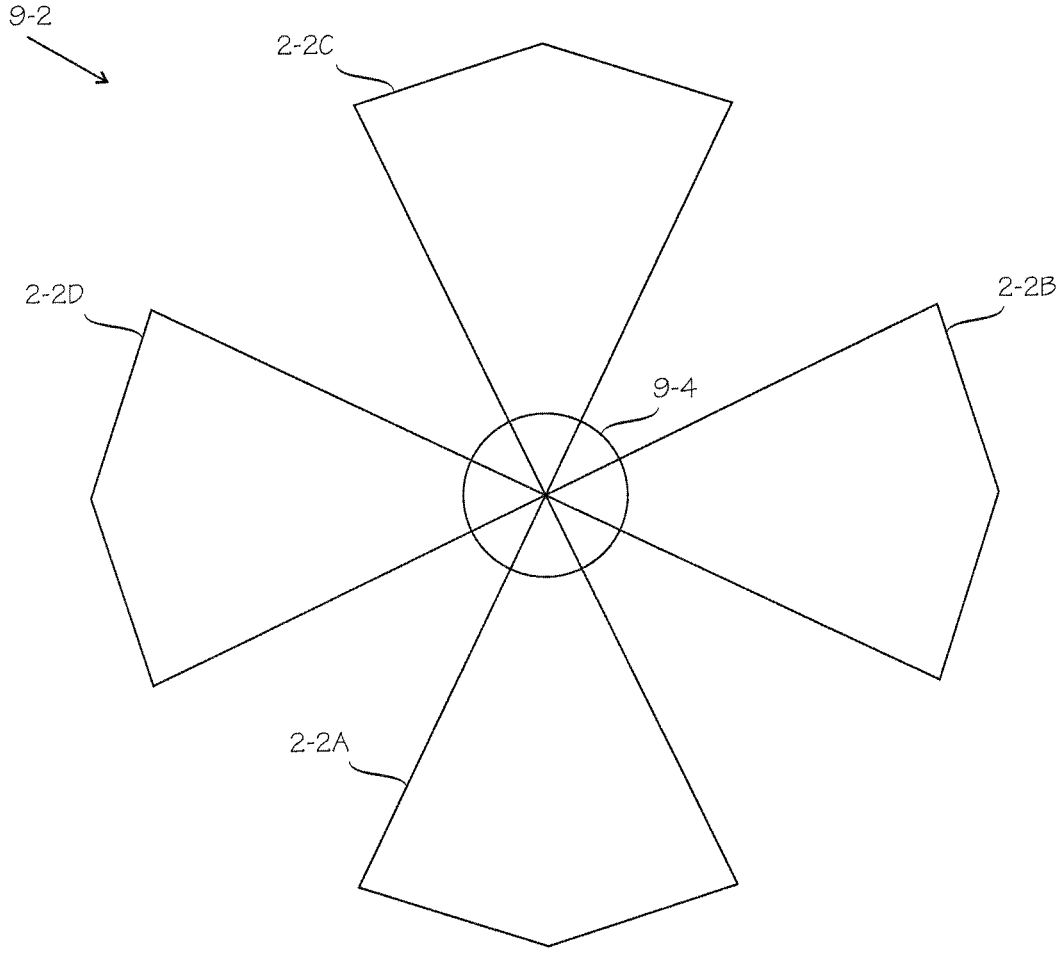
FIG. 9 shows an arrangement of four display areas for four musicians or two parameters for each of two musicians.

FIG. 9 shows an arrangement 9-2 of four display areas 2-2A, 2-2B, 2-2C, 2-2D for four musicians (or two parameters for each of two musicians). Each of the four display areas corresponds to the display area 2-2 described earlier. The arrangement 9-2 comprises an area 9-4 that covers a part of each of the display areas 2-2A . . . 2-2D. The area 9-4 can be used in a competitive manner. In one exemplary competition, the winner is the musician who first occupies the area 9-4. In another exemplary competition the multiple musicians compete as teams wherein the aim is for all musicians of the team (or all displayed parameters of the musicians) to occupy the area 9-4.

Detection of Onsets, Pitch and Dynamics

Onsets indicate when a new note is a played. For the purpose of describing how onsets can be detected it is convenient to classify an onset as either hard or soft. A hard onset is characterized by a quick rise in energy, and it occurs for example when a guitarist picks a string or a drummer hits a practice pad. A soft onset is characterized by a change in the frequency content without an associated large increase in level, such as when a guitarist performs a slide or a pitch-bend (using the left hand to change the pitch without picking the strings with the right hand). Thus, detecting an onset usually requires locating a sudden increase in energy or a sudden change in the frequency spectrum. It is common to determine an onset through three stages: 1) time-frequency processing of the input signal followed by 2) feature extraction and 3) onset detection based on the value of a decision function calculated from the extracted features [Bello, 2005]. As an example of how to detect a hard onset from the energy or level increase only, the input's energy envelope can be calculated by summing up the square of the samples inside short frames, and when the energy increases over three consecutive frames an onset is detected. For soft onsets, a detection method must consider the frequency distribution so it is not enough to use only the total energy as a feature. One approach for soft onsets is to calculate the spectral flux (the sum of absolute differences between two spectrums) S between adjacent frames, and when S exceeds a certain threshold an onset is detected [Bello, 2005]. Onset detection can also combine energy features with frequency features in order to make the method more robust [Klapuri, 1999]. For example, the energy envelope can be calculated for several frequency bands and the final onset detection is based on a combination of these frequency bands. Even more sophisticated methods based on machine learning exist. Such methods are typically based on classifiers such as SVM (Support Vector Machine), kNN (k-Nearest Neighbour), and Naive Bayes [Chuan, 2006]. Other methods can be found from [Bello, 2003]. Pitch estimation attempts to extract the important frequencies that make up a signal. In practice it is necessary to distinguish between single pitch- and multi-pitch signals. Virtually all sounds are composed of a multitude of frequencies, but describing a signal as single pitch effectively suggests that it is produced by a single sound source such as one vibrating guitar string or one human voice singing. Multi-pitch signals are more complex, and they can be produced by any number of simultaneous sound sources such as an orchestra or one guitarist letting several strings ring at the same time. In the case of single-pitch sounds the task is to detect the fundamental frequency which is the lowest rate at which the signal repeats. Most methods for estimating the period of a signal are based on analyzing the autocorrelation function. See, for example, the YIN algorithm [Cheveigne, 2002]. Other pitch estimation techniques can be found in [Rabiner, 1976], [Charpentier, 1986], [Klapuri, 2000], [Tolonen, 2000].

Dynamics reflect whether a musician's playing is loud or quiet. It is very important as an indicator of certain types of performance problems such as a drummer consistently playing louder with the right hand than the left or a guitarist playing louder when picking with a downstroke than with an upstroke. The level of an audio signal is usually calculated by a short-term average of its energy [Boley, 2010]. When the purpose is to judge whether a sequence of events are at the same level it does not matter what that level is. However, when the musician has to play a sequence of events that has changing dynamics, such as a crescendo, it is necessary to set a reference level in order to classify events as 'too loud' or 'too quiet'. However, it is not obvious how to normalize the level when recording a musician since the recorded level depends on the distance to the microphone as well as on the particular musical instrument and the musician's playing style. Consequently, a reference level must be calculated in the recording situation. One method is to set the reference level L (in dB) to the loudest recorded event, and then consider the music dynamics 'forte' to be L. Other music dynamics can then be set relative to L. For example, 'piano' can be set to L-6 dB.

In the MIDI specifications 1.0 [MIDI, 1995] it is specified that a Channel Message contains information about the timing of onsets (Note-On and Note-Off, unit MIDI-ticks), pitch (Note Numbers and Pitch Bend, integer between 0 and 127), and dynamics (Velocity and Aftertouch, integer between 0 and 127). Consequently, everything that is needed for the classification of a note event is readily available in the Channel Messages transmitted via the MIDI protocol.

Those skilled in the art will realize that the inventive principle may be modified in various ways without departing from the spirit and scope of the present invention.

REFERENCE DOCUMENTS

[MIDI, 1995] MIDI Manufacturers Association, Midi Implementation Chart (Version 2), 1995, URL: http://www.midi.org/techspecs/midi_chart-v2.pdf

[Boley, 2010] J. Boley, M. Lester, and C. Danner, Measuring Dynamics: Comparing and Contrasting Algorithms for the Computation of Dynamic Range, Audio Engineering Society Convention 129, paper number 8178, San francisco, Calif., USA, Nov. 4-7, 2010.

Onset

[Bello, 2005] Bello, J. P.; Daudet, L.; Abdallah, S.; Duxbury, C.; Davies, M.; Sandler, Mark B., "A Tutorial on Onset Detection in Music Signals", Speech and Audio Processing, IEEE Transactions on, vol. 13, no. 5, pp. 1035, 1047, September 2005

[Klapuri, 1999] A. Klapuri, "Sound onset detection by applying psychoacoustic knowledge", Proc. IEEE Int. Conf. Acoust., Speech, Signal Process. (ICASSP'99), March 1999, pp. 3089-3092.

[Bello, 2003] J. P. Bello and M. Sandler, "Phase-based note onset detection for music signals", in Proc. IEEE Int. Conf. Acoust., Speech, Signal Proces. (ICASSP'03), Hong Kong, China, 2003, pp. 49-52.

[Chuan, 2006] Ching-Hua Chuan; Chew, E., "The Effect of Key and Tempo on Audio Onset Detection Using Machine Learning Techniques: A Sensitivity Analysis", Multimedia, 2006.

Pitch

[Rabiner, 1976] Rabiner, L. R. et. al: "Comparative Performance Study of Several Pitch Detection Algorithms", IEEE Trans. on Acoust., Speech, and Signal Processing, vol. ASSP-24, No. 5 December 1976

[Cheveigné, 2002] A. de cheveigné, and H. Kawahare, "YIN, a fundamental frequency estimator for speech and music", The Journal of the Acoustical Society of America, 111 (4): 1917-30, 2002

[Charpentier, 1986] Charpentier, F., "Pitch detection using the short-term phase spectrum", Acoustics, Speech, and Signal Processing, IEEE International Conference on ICASSP '86., vol. 11, no., pp. 113, 116, April 1986

[Klapuri, 2000] Klapuri, A., Virtanen, T., Holm, J.-M., "Robust multipitch estimation for the analysis and manipula- TION OF POLYPHONIC MUSICAL SIGNALS", IN PROC. COST-G6 CONFERENCE ON DIGITAL AUDIO EFFECTS, DAFX-00, VERONA, ITALY, 2000.

[TOLONEN, 2000] T. TOLONEN AND M. KARJALAINEN. "A COMPUTATIONALLY EFFICIENT MULTIPITCH ANALYSIS MODEL", IEEE TRANSACTIONS ON SPEECH AND AUDIO PROCESSING, VOL. 8, NO. 6, NOVEMBER 2000.

The invention claimed is:

1. A method comprising:

analyzing a performance of a musical piece wherein the musical piece comprises a sequence of musical events, wherein at least some of the musical events have a plurality of parameters, wherein the parameters are selected from a group which comprises timing, pitch and dynamics;

wherein said analyzing comprises execution of following acts on a data processing system:

inputting the performance of the musical piece;

accessing a standard performance of the musical piece;

identifying a plurality of mutually corresponding events in the musical performance and in the standard performance, wherein the events have one or more parameters;

for each identified event:

comparing one or more parameters of the musical performance with corresponding parameters of the standard performance;

for each of the one or more compared parameters, determining one of a set of classes and, wherein the set of classes comprises:

a "correct" class for parameters within a given tolerance margin of the corresponding parameter of the standard performance;

a "low" class for parameters below the corresponding parameter of the standard performance; and a "high" class for parameters above the corresponding parameter of the standard performance;

for each of the one or more compared parameters, displaying a current marker on an area of a display, wherein the area is defined by a corner for each of the classes;

determining a position for the current marker as a step from the position of a previous marker, or from a start position if no previous marker exists, wherein the direction of the step indicates the determined class and wherein the length of the step is based on at least the distance from the previous marker to the corner for the determined class; and using a set of one or more visual attributes that distinguish the currently displayed marker from a background and/or the previous marker, if any, in the determined position.

2. The method according to claim 1, wherein the performance of the musical piece is a live performance and the analyzing comprises real-time execution of the acts according to claim 1.

3. The method according to claim 1, wherein the set of classes also comprises a "missed" class for events that were omitted or events in which the parameter of the musical performance deviates from the corresponding parameter of the standard performance by more than a predetermined threshold.

4. The method according to claim 1, wherein the parameters comprise timing, pitch and level.

5. The method according to claim 1, wherein the length of the step is also based on a match between the compared parameter and the determined class.

6. The method according to claim 1, wherein the length of the step is increased for events in which the determined class changes from "low" to "high" or vice versa.

7. A data processing system comprising:

a memory system for storing program code instructions and data;

a processing system including at least one processing unit, wherein the processing system executes at least a portion of the program code instructions and processes the data;

an interface for receiving data representative of a performance of a musical piece, which comprises a sequence of musical events, wherein at least some of the musical events have a plurality of parameters, wherein the parameters are selected from a group which comprises timing, pitch and dynamics;

wherein the memory system stores program code instructions that, when executed by the processing system, instruct the processing system to perform the following acts:

inputting the performance of the musical piece;

accessing a standard performance of the musical piece;

identifying a plurality of mutually corresponding events in the musical performance and in the standard performance, wherein the events have one or more parameters;

for each identified event:

comparing one or more parameters of the musical performance with corresponding parameters of the standard performance;

for each of the one or more compared parameters, determining one of a set of classes and, wherein the set of classes comprises:

a "correct" class for parameters within a given tolerance margin of the corresponding parameter of the standard performance;

a "low" class for parameters below the corresponding parameter of the standard performance; and a "high" class for parameters above the corresponding parameter of the standard performance;

for each of the one or more compared parameters, displaying a current marker on an area of a display, wherein the area is defined by a corner for each of the classes;

determining a position for the current marker as a step from the position of a previous marker, or from a start position if no previous marker exists, wherein the direction of the step indicates the determined class and wherein the length of the step is based on at least the distance from the previous marker to the corner for the determined class; and using a set of one or more visual attributes that distinguish the currently displayed marker from a background and/or the previous marker, if any, in the determined position.

8. A data processing system comprising:

a memory system for storing program code instructions and data;

a processing system including at least one processing unit, wherein the processing system executes at least a portion of the program code instructions and processes the data;

an interface for receiving data representative of a performance of a musical piece, which comprises a sequence of musical events, wherein at least some of the musical events have a plurality of parameters, wherein the parameters are selected from a group which comprises timing, pitch and dynamics, wherein the performance of the musical piece is a live performance and the analyzing comprises real-time execution of the acts according to claim 1.

9. The data processing system according to claim 7, wherein the set of classes also comprises a "missed" class for events that were omitted or events in which the parameter of the musical performance deviates from the corresponding parameter of the standard performance by more than a predetermined threshold.

10. The data processing system according to claim 7, wherein the parameters comprise timing, pitch and level.

11. The data processing system according to claim 7, wherein the length of the step is also based on a match between the compared parameter and the determined class.

12. The data processing system according to claim 7, wherein the length of the step is increased for events in which the determined class changes from "low" to "high" or vice versa.

13. A tangible data processing carrier comprising:

program code instructions executable on a data processing system, which comprises:

a memory system for storing program code instructions and data;

a processing system including at least one processing unit, wherein the processing system executes at least a portion of the program code instructions and processes the data;

an interface for receiving data representative of a performance of a musical piece, which comprises a sequence of musical events, wherein at least some of the musical events have a plurality of parameters, wherein the parameters are selected from a group which comprises timing, pitch and dynamics;

wherein the program code instructions, when executed by the processing system, instruct the processing system to perform the following acts:

inputting the performance of the musical piece;

accessing a standard performance of the musical piece;

identifying a plurality of mutually corresponding events in the musical performance and in the standard performance, wherein the events have one or more parameters;

for each identified event:

comparing one or more parameters of the musical performance with corresponding parameters of the standard performance;

for each of the one or more compared parameters, determining one of a set of classes and, wherein the set of classes comprises:

a "correct" class for parameters within a given tolerance margin of the corresponding parameter of the standard performance;

a "low" class for parameters below the corresponding parameter of the standard performance; and a "high" class for parameters above the corresponding parameter of the standard performance;

for each of the one or more compared parameters, displaying a current marker on an area of a display, wherein the area is defined by a corner for each of the classes;

determining a position for the current marker as a step from the position of a previous marker, or from a start position if no previous marker exists, wherein the direction of the step indicates the determined class and wherein the length of the step is based on at least the distance from the previous marker to the corner for the determined class; and using a set of one or more visual attributes that distinguish the currently displayed marker from a background and/or the previous marker, if any, in the determined position.

* * * * *